United States Patent [19]

Micoud et al.

[11] Patent Number: 4,821,008

[45] Date of Patent: Apr. 11, 1989

[54] LATCHING OPERATING MECHANISM OF A THREE-POSITION CIRCUIT BREAKER

[76] Inventors: Robert Micoud, 7, rue des Peupliers, F 38120 Le Fontanil; Michel Berne, 6, rue des Charmilles, F 38120 Saint-Egreve, both of France

[21] Appl. No.: 145,979

[22] Filed: Jan. 20, 1988

[30] Foreign Application Priority Data

Jan. 21, 1987 [FR] France ..... 87 00750

[51] Int. Cl.[4] ..... H01H 3/54

[52] U.S. Cl. ..... 335/189; 200/400; 335/76

[58] Field of Search ..... 335/189, 171, 166, 76, 335/26; 200/153 SC

[56] References Cited

U.S. PATENT DOCUMENTS 4,400,670 8/1983 Mostosi ..... 335/189

FOREIGN PATENT DOCUMENTS 0058585 8/1982 European Pat. Off. .

3036670 4/1982 Fed. Rep. of Germany .

*Primary Examiner*—H. Broome

*Attorney, Agent, or Firm*—Parkhurst, Oliff & Berridge

[57] ABSTRACT

A latching mechanism comprises an energy storage system having a first closing spring, and a second opening and earthing spring, arranged between a transmission device and a closing control crankshaft and an earthing crank. A retaining plate pivoting on an axis cooperates on the one hand with an opening control lock by means of a unidirectional locking and on the other hand with the crankshaft by means of two latchings. The first latching is released during the opening travel after the lock has been unlocked, and the second latching causes positive locking of the device at the beginning of the closing travel of the crankshaft.

7 Claims, 4 Drawing Sheets

LATCHING OPERATING MECHANISM OF A THREE-POSITION CIRCUIT BREAKER

BACKGROUND OF THE INVENTION

The invention relates to an operating mechanism of an electrical switchgear device, especially a multipole circuit breaker or a fuse-switch incorporated in an electrical distribution cubicle, connected by means of connecting cables, the movable assembly of the circuit breaker being able to occupy three distinct stable positions, namely a first position in which the contacts are closed, a second intermediate position in which the contacts are open, and a third earthed position in which the outgoing cables are electrically earthed by means of the movable contacts of the corresponding phases, the kinematic transmission system of said mechanism comprising:

an elastic energy storage system associated with a rotary transmission device securedly united to the movable assembly, operating means operating in conjunction with the energy storage system to actuate the transmission device in one of the three positions, earthing being accomplished from the second intermediate position O, and blocking means of the transmission device in each of the three positions of the circuit breaker.

A mechanism of the kind mentioned is described in French Pat. No. 2,500,222 and comprises a single spring associated with a toggle-joint and an operating crank. A tumbler-type mechanism of this kind is perfectly suited to switches having average breaking performances, but is not suitable for switchgear with higher performances, notably circuit breakers.

SUMMARY OF THE INVENTION

The object of the invention consists in increasing the power of an operating mechanism, so as to enable it to be used in either a fuse-switch or a circuit breaker.

The mechanism according to the invention is characterized in that the energy storage system comprises a first spring arranged between a first drive pin of the transmission device and a crankshaft wedged onto a shaft extending parallel to the spindle of the transmission device and a second spring fitted between a second drive pin of the transmission device and an earthing control crank mechanically connected to said blocking means, and that a pivoting retaining plate cooperates on the one hand with an opening control lock by means of a unidirectional locking, and on the other hand with the crankshaft by means of a first latching released during the opening travel by the expansion action of the first spring, subsequent to the lock being released, and by means of a second latching capable of occupying an active positive locking position of the transmission device at the beginning of the closing travel of the crankshaft and an inactive unlocking position of said device.

The mechanism according to the invention is of the latching kind particularly suited to control of three-position circuit breakers.

Manual closing is achieved by means of the crankshaft having a cam operating in conjunction with two rollers angularly offset on a retaining plate to constitute the first and second latchings.

The retaining plate comprises a latching nose designed to lock the first drive pin when the second latching is in the active position due to the action of the crankshaft. This results in the first spring being fully compressed when a closing operation is performed.

The kinematic transmission system comprises in addition a braking device which becomes active during the opening travel after the contacts have separated to temporarily block the transmission device. The transmission device is advantageously fitted with a roller capable of coming into engagement with a retractable lever in an intermediate position of the opening travel, braking being achieved by means of a hydraulic damper. A device of this kind is of particular interest when arc breaking is accomplished by magnetic blow-out by means of a permanent magnet.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
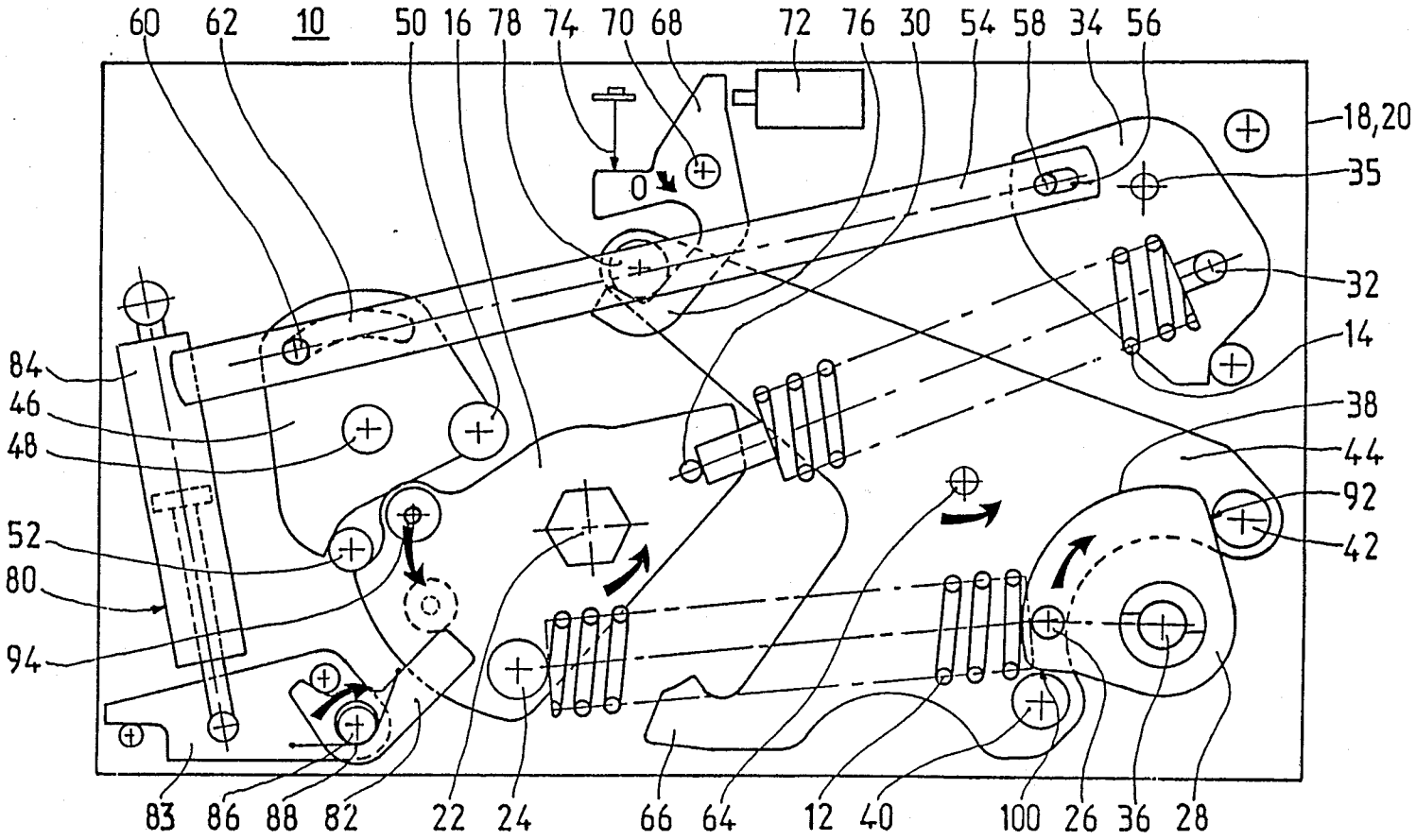
FIG. 1 shows an elevational view of the mechanism according to the invention, in the closed position of the circuit breaker.

In the figures, the latching-type operating mechanism 10 actuates the movable assembly (not represented) of a three-phase circuit breaker with separable contacts, the assembly being housed in a medium voltage electrical distribution cubicle. The movable assembly of the circuit breaker can occupy three distinct stable positions, namely a position F in which the contacts are closed, an intermediate open insulated position O after the contacts have separated, and an earthed position T in which the outgoing cable of each phase is electrically earthed by means of the corresponding movable contact of the circuit breaker.

The latching mechanism 10 is arranged between two parallel mounting plates 18, 20, made of metallic material, and comprises two energy storage compression springs 12, 14, capable of operating in conjunction with a transmission device 16 securedly united to the drive lever of the movable assembly. The lower spring 12 ensures closing of the circuit breaker, whereas the upper spring 14 causes opening and earthing. The transmission device 16 is mounted with rotation on a transverse spindle 22 between three positions F, O and T of the circuit breaker. The guide of the lower spring 12 bears at one end on a first drive pin 24 of the transmission device 16, and at the opposite end on a crank pin of a closing control crankshaft. The upper spring guide is fitted between a second drive pin of the transmission device and an anchoring point located on an earthing control crank 34.

The crankshaft 28 is mounted with rotation on a shaft 36, and has an edge forming a cam 38 operating in conjunction with two rollers 40, 42, fixed at predetermined points to a retaining plate 44. A locking crank 46 is mounted with limited pivoting on a spindle 48 to block the transmission device 16 in each of the positions F, O and T of FIGS. 1 to 3. A roller 50 of the locking crank 46 is designed to stop the rotational movement of the transmission device 16 in the open position O (FIG. 2), and in the earthed position T (FIG. 3). Between the closed position F (FIG. 1) and the open position O (FIG. 2) of the mechanism 10, the locking crank 46 remains immobile resting against a stop 52 which also acts as a stop for the transmission device 16 when the latter is in the closed position F (figure 1).

A connecting rod 54 is arranged with clearance between the earthing control crank 34 and the locking crank 46 of the transmission device 16, in such a way as to authorize rotational movement of the latter to the earthed position T, when the crank 34 is actuated clockwise around its spindle 35, from the position O (FIG. 2) to the position T (FIG. 3). One of the ends of the connecting rod 54 is provided with an oblong opening 56 in which a crank pin 58 of the earthing crank 34 is housed. The opposite end of the connecting rod 54 bears a drive spindle 60 capable of moving in a curved groove 62 of the locking crank 46, when moving from the open position O to the earthed position T and vice-versa.

The retaining plate 44 is pivotally mounted on an intermediate spindle 64, and is equipped with a latching nose 66 designed to operate in conjunction with the first pin 24 of the transmission device 16 during the manual closing travel of the crankshaft 28. A lock 68 is mounted with limited rotation on a spindle 70 and controls opening of the circuit breaker by unlocking the retaining plate 44. A return spring (not shown) biases the lock 68 clockwise to the locked position in which the retaining plate 44 is blocked unidirectionally in counterclockwise rotation. Angular movement of the lock 68 to the unlocked position takes place counterclockwise, either by means of an automatic trip actuator 72 controlled by a trip device, or by means of a manual opening control button 74. The actuator 72 may be formed by an electromagnetic relay, a fuse-unit striker, and any other tripping auxiliary. The lock 68 comprises a latching lug 76 which cooperates in the locked position with a roller 78 located on an extension of the retaining plate 44.

The pivoting spindle 64 of the retaining plate 44 is located between the transmission device 16 and the plane passing through the shaft 36 of the crankshaft 28, and the spindle 35 of the earthing crank 34. A braking system, designated by the general reference 80, comprises a retractable hinged lever 82 cooperating via a drive lever 83 with a hydraulic dashpot-type damper 84 to temporarily slow the transmission device 16 during the movable assembly opening travel. The two levers 82, 83 are mounted with limited pivoting on the same spindle 86, on which a torsion spring 88 is also fitted (FIG. 1) biasing the retractable lever 82 in the clockwise direction, and allowing the mechanism 10 to close. A return spring (not shown) is fitted in the damper 84 to return the retractable lever 82 to the middle active position (FIG. 1) after the thrust exerted by the roller 94 controlling the transmission device 16 in the intermediate opening travel position.

Operation of the operating mechanism 10 of the three-position circuit breaker is as follows:

In the closed position F of the mechanism 10, represented in FIG. 1, the transmission device 16 comes up against the stop 52, and is held there in a stable manner by the pressure of the lower spring 12 on the first drive pin 24. The latching lug 76 of the lock 68 is in the locked position on the roller 78, and prevents any counterclockwise rotation of the retaining plate 44. The torque exerted on the transmission device 16 by the upper spring 14 is negligible in comparison with that exerted by the lower spring 12, and the crankshaft is engaged between the two rollers 40, 42. The crankshaft 28 engaging against the roller 42 of the locked retaining plate 44 constitutes a first latching 92, which will have to be released by opening the mechanism 10.

The circuit breaker is opened by means of the automatic trip actuator 72 or the manual control button 74, causing counter-clockwise pivoting of the lock 68 around the spindle 70 and unlocking of the retaining plate 44. The arrows in FIG. 1 indicate the direction of movement of the moving parts during the opening operation of the mechanism 10. The reaction of the lower spring 12 on the crank pin 26 causes clockwise rotational movement of the crankshaft 28, followed by release of the first latching 92 by counterclockwise pivoting of the retaining plate 44. The lower spring 12 expands rightwards, when the cam 38 of the crankshaft 28 slides on the roller 42, and the torque exerted by the lower spring 12 on the transmission device 16 decreases progressively. When the torque exerted by the upper spring 14 outweighs that of the lower spring 12, the transmission device 16 starts pivoting counterclockwise and is moved to the open position O.

During the opening travel of the transmission device 16, the roller 94 (see dotted line in FIG. 1) comes into contact with the actuating lever 82 of the braking device 80. The reaction of the damper 84 on the lever 82 temporarily stops the rotational movement of the transmission device 16 in an intermediate position, until the roller 94 is released. The transmission device 16 then becomes free again, and the expansion of the upper spring 14 drives it to the open position O (FIG. 2).

Figure 4:
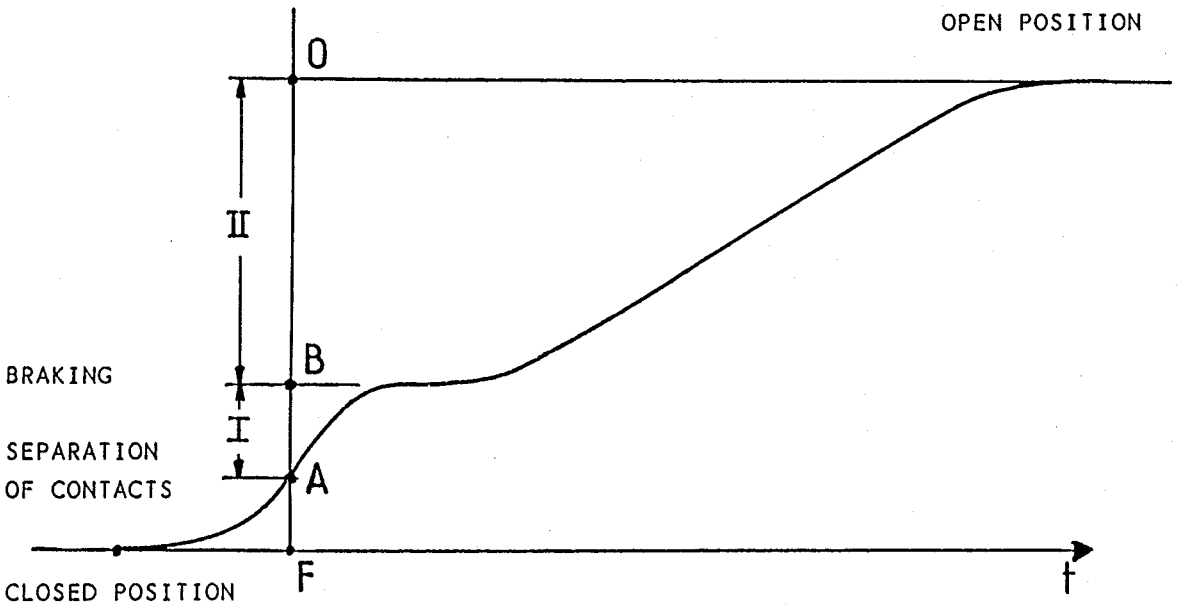
FIG. 4 represents the time diagram of the circuit breaker opening travel with the intermediate braking position.

Temporary blocking of the movable assembly of the circuit breaker by the braking device 80 takes place after the contacts have separated, during the arc extinction phase I (see FIG. 4). The stroke length AB of the movable assembly between separation of the contacts and operation of the braking device 80 is advantageously chosen within a range of 10 to 20 millimeters, when the circuit breaker is gas-insulated and equipped with a magnetic extinguishing device causing arc rotation by means of a permanent magnet. The dielectric medium is re-established during the phase II travel BO after the arc has been extinguished and the braking device 80 counteracted.

Figure 2:
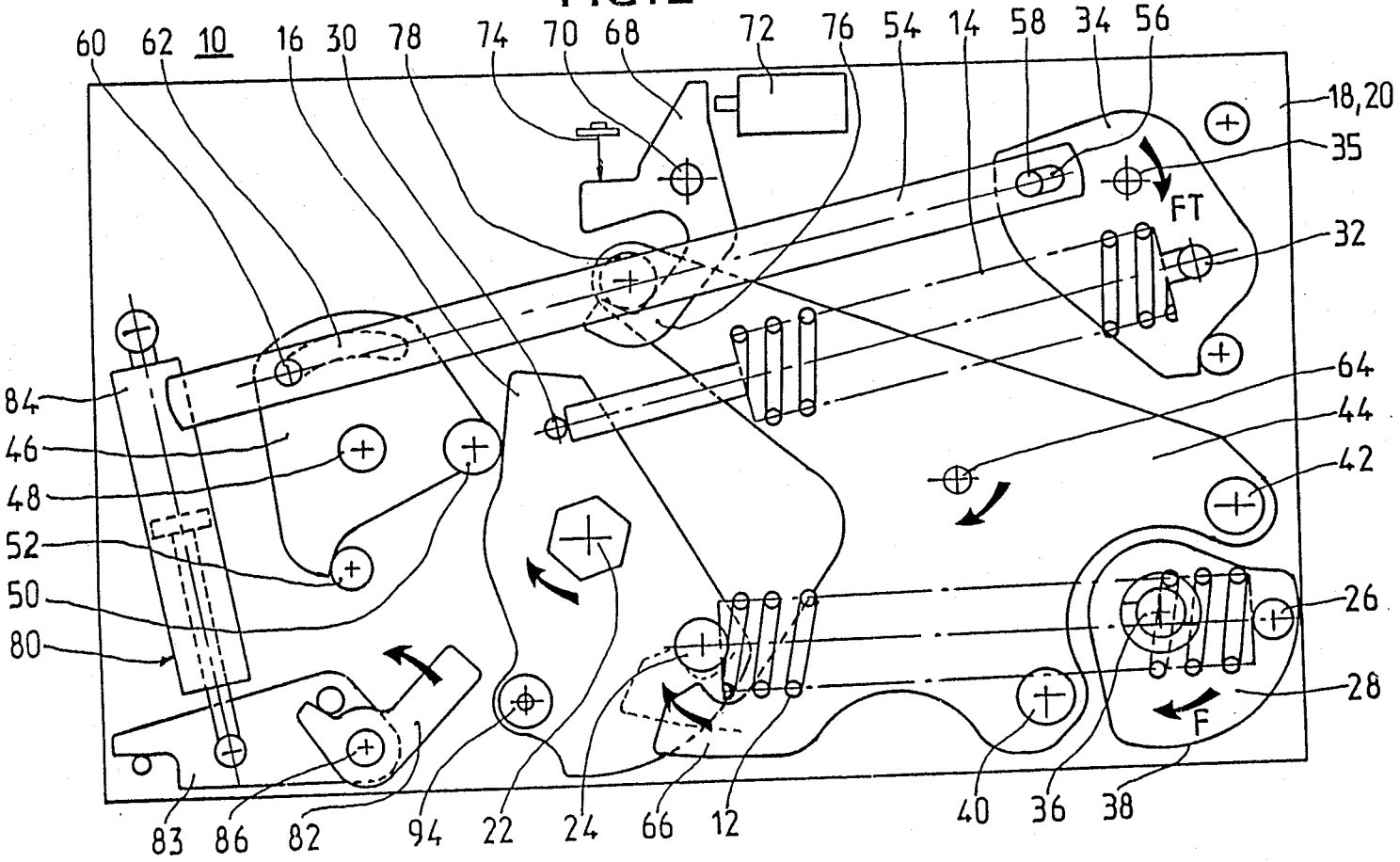
FIGS. 2 and 3 are identical views to FIG. 1, respectively in the open and earthed positions.
Figure 3:
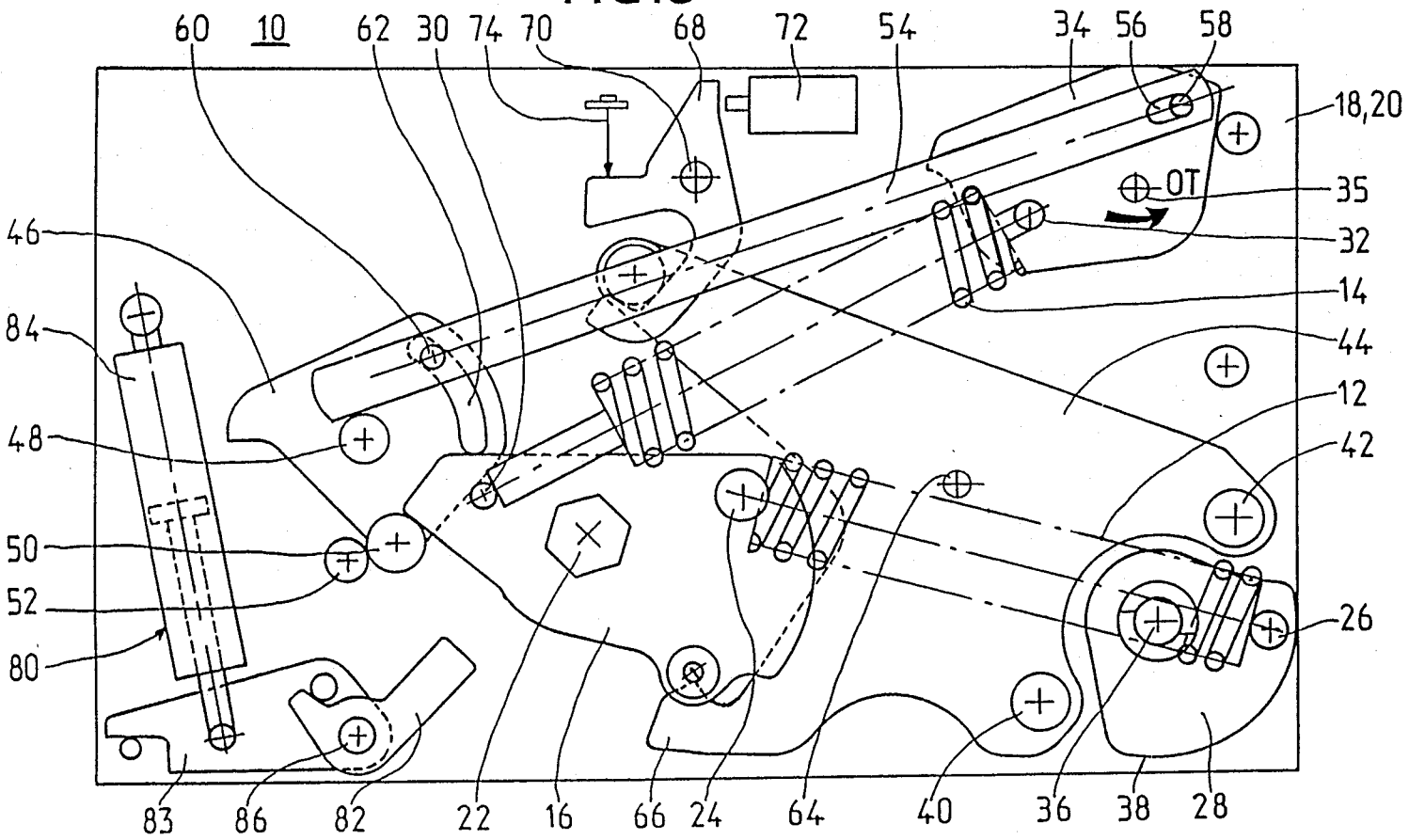

FIG. 2 represents the mechanism 10 in the open position. The crankshaft 28 has effected a clockwise half-turn from the closed position F, and the transmission device 16 is firmly resting against the roller 50 of the locking crank 46. The retaining plate 44 is once more locked by the lock 68, and the position of both the locking crank 46 and the earthing crank 34 has remained unchanged throughout the opening travel.

Reclosing of the circuit breaker from the position O (FIG. 2) to the position F (FIG. 1) is accomplished manually after an operating lever (not shown) has been engaged on the shaft 36, driving the crankshaft 28 in clockwise rotation (see arrow F in FIG. 2). The crankshaft 28 coming up against the roller 40 constitutes a second latching 100 causing pivoting of the retaining plate 44 in the same direction, in such a way as to ensure positive unidirectional locking of the transmission device 16 by engagement of the latching nose 66 with the first pin 24. This positive locking (see dotted line) is maintained throughout the sliding travel of the cam 38 on the roller 40, and prevents the circuit breaker from closing. The lower spring 12 is fully compressed during this positive locking phase. The latching nose 66 is released automatically when the cam 38 comes free of the roller 40. The lower spring 12 expanding leftwards then causes the transmission device 16 to rotate clockwise, and the mechanism 10 returns to the closed position F (FIG. 1). During this closing travel, the roller 94 of the transmission device 16 pushes the lever 82 back without the braking device 80 operating. The torsion spring 88 then resets the lever 82 to its active position, after the roller 94 has passed.

The earthing operation is performed manually from the open position O (FIG. 2) of the mechanism 10, by means of an operating device (not shown) causing the earthing crank 34 to pivot clockwise a quarter-turn (see arrow FT in FIG. 2). The rightwards movement of the connecting rod 54 causes the locking crank 46 to move clockwise, allowing the transmission device 16 to pivot counterclockwise due to the action of the upper spring 14. FIG. 3 shows the earthed position T of the mechanism 10. The crankshaft 28 and retaining plate 44 have remained immobile and do not operate during this movement between the open position O and the earthed position T.

The mechanism 10 is returned manually to the open position O in FIG. 2 by a reverse movement of the crank 34 (see arrow OT in FIG. 3).

We claim:

1. An operating mechanism of an electrical switchgear device, especially a multipole circuit breaker or a fuse-switch, incorporated in an electrical distribution cubicle, connected by means of connecting cables, the movable assembly of the circuit breaker being able to occupy three distinct stable positions, namely a first position F in which the contacts are closed, a second intermediate position O in which the contacts are open, and a third earthed position T in which the outgoing cables are electrically earthed by means of the movable contacts of the corresponding phases, the kinematic transmission system of said mechanism (10) comprising:

an elastic energy storage system (12, 14), associated with a rotary transmission device (16) securedly united to the movable assembly, operating means (28, 68, 72, 74, 34) operating in conjunction with the energy storage system (12, 14) to actuate the transmission device (16) in one of the three positions, earthing being accomplished from the second intermediate position O, blocking means (46, 50, 52) of the transmission device (16) in each of the three positions F, O, T, of the circuit breaker, a first spring (12) of the energy storage system being arranged between a first drive pin (24) of the transmission device (16), and a crankshaft (28) wedged onto a shaft (36) extending parallel to the spindle (22) of the transmission device (16), a second spring (14) of the energy storage system being fitted between a second drive pin (30) of the transmission device (16) and an earthing control crank (34) mechanically connected to said blocking means, a pivoting retaining plate (44) cooperating on the one hand with an opening control lock (68) by means of a unidirectional locking (76, 78, and on the other hand with the crankshaft (28) by means of a first and a second latching (92, 100), said first latching (92) being released during the opening travel by the expansion action of the first spring (12), subsequent to the lock (68) being released, said second latching (100) being capable of occupying an active positive locking position of the transmission device (16) at the beginning of the closing travel of the crankshaft (28), and an inactive unlocking position of said device (16).

2. An operating mechanism according to claim 1, wherein the retaining plate (44) is mounted with limited pivoting on a spindle (64) arranged inside a quadrilateral whose corners correspond to the locations of the spindle (70) of the lock (68), the spindle (35) of the earthing control crank (34), the shaft (36) of the crankshaft (38), and the pivoting spindle (22) of the transmission device (16).

3. An operating mechanism according to claim 1, having a control cam (38) on the crankshaft (28) capable of cooperating with two rollers (40, 42) angularly offset on the retaining plate (44) to constitute said first and second latchings (92, 100).

4. An operating mechanism according to claim 1, having a latching nose (66) on the retaining plate (44) to lock the first drive pin (24), when the second latching (100) is in the active position due to the action of the crankshaft (28).

5. An operating mechanism according to claim 1, having a braking device (80) rendered active during the opening travel after separation of the contacts to temporarily block the transmission device (16), said opening control lock (68) being controlled either by an automatic trip actuator (72) or by a manual control button (74).

6. An operating mechanism according to claim 5, having a retractable lever (82) on the braking device (80) to cooperate with a hydraulic damper (84), and a roller (94) on the transmission device (16) designed to come into engagement with said lever (82) in an intermediate position of the opening travel of said device (16).

7. An operating mechanism according to claim 1, having a locking crank (46) connected with clearance to the earthing control crank (34) by means of a connecting rod (54) capable of actuating said locking crank between a first locking position in the closed position F and the open position O of the mechanism, and a second blocking position in the earthed position T.

* * * * *